US007850383B2

(12) United States Patent
Bober et al.

(10) Patent No.: US 7,850,383 B2
(45) Date of Patent: Dec. 14, 2010

(54) FLOOR FINISH APPLICATOR

(75) Inventors: Andrew M. Bober, Racine, WI (US); Michael S. Joss, Chicago, IL (US)

(73) Assignee: Diversey, Inc., Sturtevant, WI (US)

( * ) Notice: Subject to any disclaimer, the term of this patent is extended or adjusted under 35 U.S.C. 154(b) by 590 days.

(21) Appl. No.: 11/744,967

(22) Filed: May 7, 2007

(65) Prior Publication Data

US 2008/0279612 A1 Nov. 13, 2008

(51) Int. Cl.
*B43M 11/02* (2006.01)

(52) U.S. Cl. ..... 401/137; 401/139; 401/48; 15/98

(58) Field of Classification Search ..... 401/48, 401/118, 123, 136, 261, 265, 268, 270, 271, 401/273–275, 278, 279, 282, 287, 137–139, 401/195; 222/105; 15/49.1, 98, 147.1–154.2; 118/108, 109, 305, 207, 208, 304, 307
See application file for complete search history.

(56) References Cited

U.S. PATENT DOCUMENTS 2,979,756 A * 4/1961 Wallis ..... 401/48
3,457,015 A * 7/1969 Taber ..... 401/48
3,981,596 A * 9/1976 Melton ..... 401/48
4,124,315 A 11/1978 Melton ..... 401/48
4,588,318 A * 5/1986 O'Brien et al. ..... 401/146
6,017,163 A * 1/2000 Keppers et al. ..... 401/48
6,524,386 B1 * 2/2003 Slager, Sr. ..... 118/207
6,827,237 B2 * 12/2004 Yorn et al. ..... 222/105
6,854,912 B2 2/2005 Dyer et al.
7,137,170 B1 * 11/2006 Morey et al. ..... 15/321
7,160,044 B2 * 1/2007 Dyer et al. ..... 401/139

OTHER PUBLICATIONS

Pages 1-10 of an Owner's Manual entitled Ultra-Trak Model 500, dated Mar. 4, 2005.
Two pages showing an advertisement of the KiaMotion II Kaivac Cleaning Systems dated Feb. 14, 2006.
Two pages showing an advertisement of the KiaMotion Kaivac Cleaning Systems dated Feb. 14, 2006.
One page of an advertisement showing the Hillyard Multi-Flo Automated Applicator, undated, admitted prior art.
One page of an advertisement showing the Hillyard, The Cleaning Resource dated Feb. 14, 2006.
One page of a Newsletter showing the KiaMotion SUV Kiavac Cleaning Systems dated Feb. 14, 2006.
The International Search Report from the Korean Intellectual Property Office.

* cited by examiner

*Primary Examiner*—Gregory L. Huson
*Assistant Examiner*—Keegan Gumbs
(74) *Attorney, Agent, or Firm*—Michael Best & Friedrich LLP

(57) ABSTRACT

A walk-behind floor finish applicator wherein a mop with a handle is connected to the applicator, yet is readily removable therefrom. This allows the mop to be used as a component of the walk-behind applicator for applying floor finish to easily accessible areas in one instance, yet allows the mop to be used independently for application of floor finish to not so easily accessible areas. The applicator is adaptable to receiving bag in the box floor finish, thus reducing cleaning time. The applicator employs a minimum number of disposable parts thus making it economical to produce.

14 Claims, 6 Drawing Sheets

FLOOR FINISH APPLICATOR

CROSS-REFERENCE TO RELATED APPLICATIONS

None.

FIELD OF THE INVENTION

The present invention relates to applicators for floor finish. More particularly, it relates to a simplified walk-behind floor finish applicator which utilizes a detachable mop as a component of a walk behind cart

BACKGROUND OF THE INVENTION

Walk-behind floor finish applicators are disclosed in U.S. Pat. Nos. 2,979,756; 3,457,015; 3,981,596 and 4,124,315. Other floor finish applicators of this type are available from Fast-Trak Inc. as Ultra-Trak floor finish applicator and Hillyard, Inc. of St. Joseph, Mo. as Multi-Flo applicator.

These applicators involve mechanisms which have numerous components and/or do not provide for a separate mopping function. For example, the applicators described in U.S. Pat. Nos. 2,979,756 and 3,981,596 include pressurized tanks with complex delivery systems. These involve time consuming cleaning operations. Those described in U.S. Pat. Nos. 3,457,015 and 4,124,315 do not provide for a separate mopping function.

A walk-behind floor finish applicator should be simple in its construction so as to be economical to produce. It should also be capable of applying floor finish in those places where the application cannot readily be acheived.

The prior art does not provide a floor finish applicator which has a minimum number of parts, yet can apply floor finish in floor areas which are both readily accessible by a mobile machine and those which are not. Neither does the prior art provide a floor finish applicator of the foregoing type which is easily operated.

SUMMARY OF THE INVENTION

The present invention provides a walk-behind floor finish applicator which includes a wheeled cart and receives a source of floor finish. A floor finish spreading mop having a handle member and a floor finish spreading member is detachably mounted on the cart. The spreading mop is mounted on a front side of the cart. A spreader bar member is connected to the front side of the cart. There is at least one conduit connected to the source of floor finish and the spreader bar for depositing floor finish on a floor. A valve member is operatively associated with the conduit, and a valve actuating member is operatively connected to the valve member.

In a preferred manner there is a skid member connected to the cart, the mop positioned on the cart in a manner to position the cart at about 5 degrees from an upright position toward the front side of the cart.

In another embodiment, there is a carrier member connected to the cart and a bag in the box containing a floor finish positioned in the carrier member.

In one aspect, there are two spreader bar members with one of the spreader bar members pivotally connected the other spreader bar member and fastened thereto by a bracket member and a pin.

In yet another aspect, the spreader bar members support two of the conduit members.

In another preferred embodiment, the floor finish spreading mop is detachably mounted to the cart by a clamp member.

In yet another preferred manner, the valve member is a pinch valve.

A general object of the invention is to provide a walk-behind floor finish applicator which can apply floor finish to easily accessible areas of the floor as well as those which are not.

Another object of the invention is to provide a floor finish applicator of the foregoing type which is easily operated.

Still another object is to provide a floor finish applicator of the foregoing type which is easily maintained.

Yet another object is to provide a floor finish applicator of the foregoing type which can be produced at low cost.

Still yet another object is to provide a floor finish applicator with a detachable mop, the mop having both coarse and fine fibers to afford spreading and leveling of the floor finish.

DESCRIPTION OF THE PREFERRED EMBODIMENTS

Figure 1:
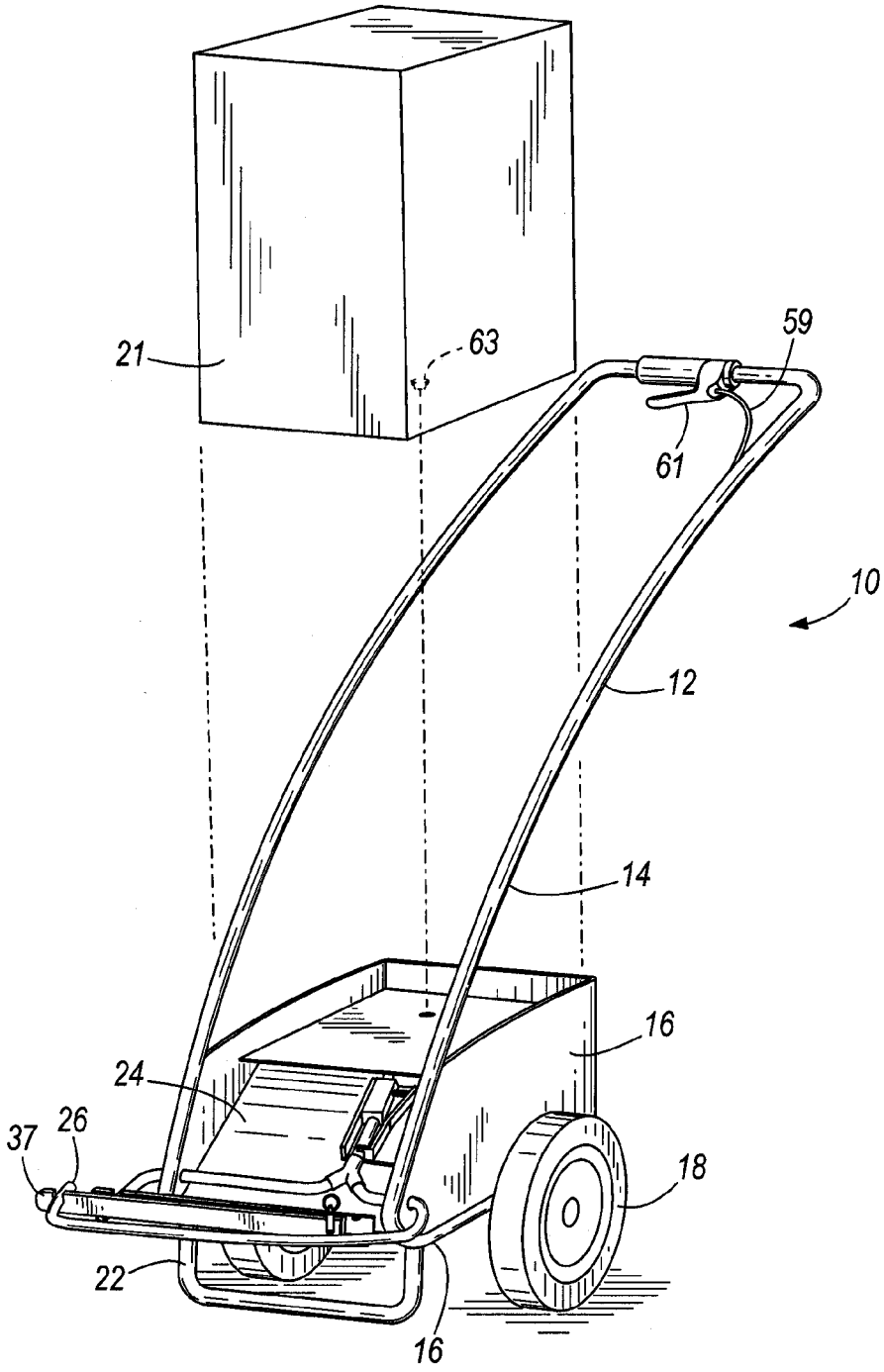
FIG. 1 is a perspective view of the floor finish applicator illustrating the placement of a box containing floor finish thereon.
Figure 2:
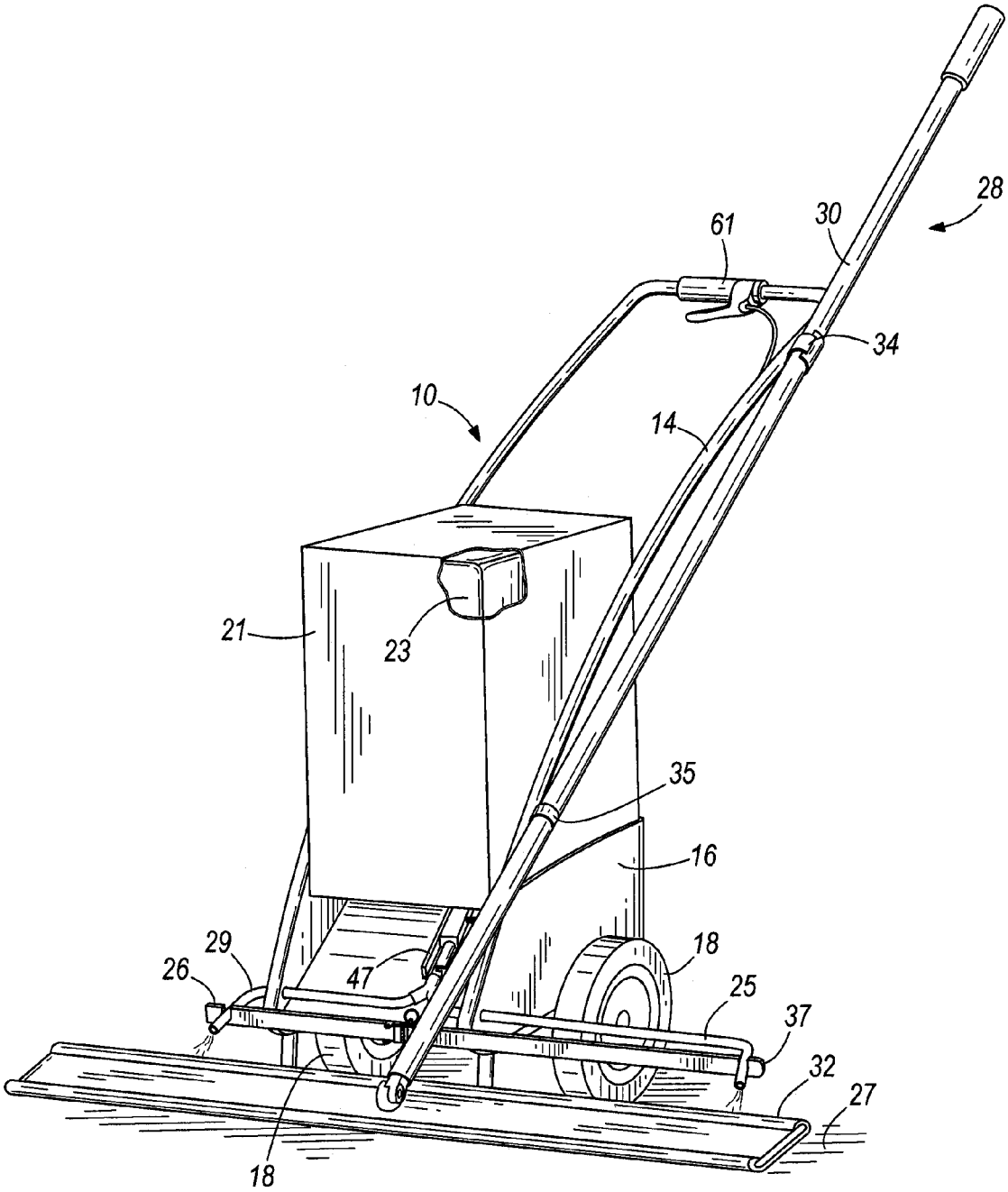
FIG. 2 is a view similar to FIG. 1 showing the attachment of a mop.
Figure 3:
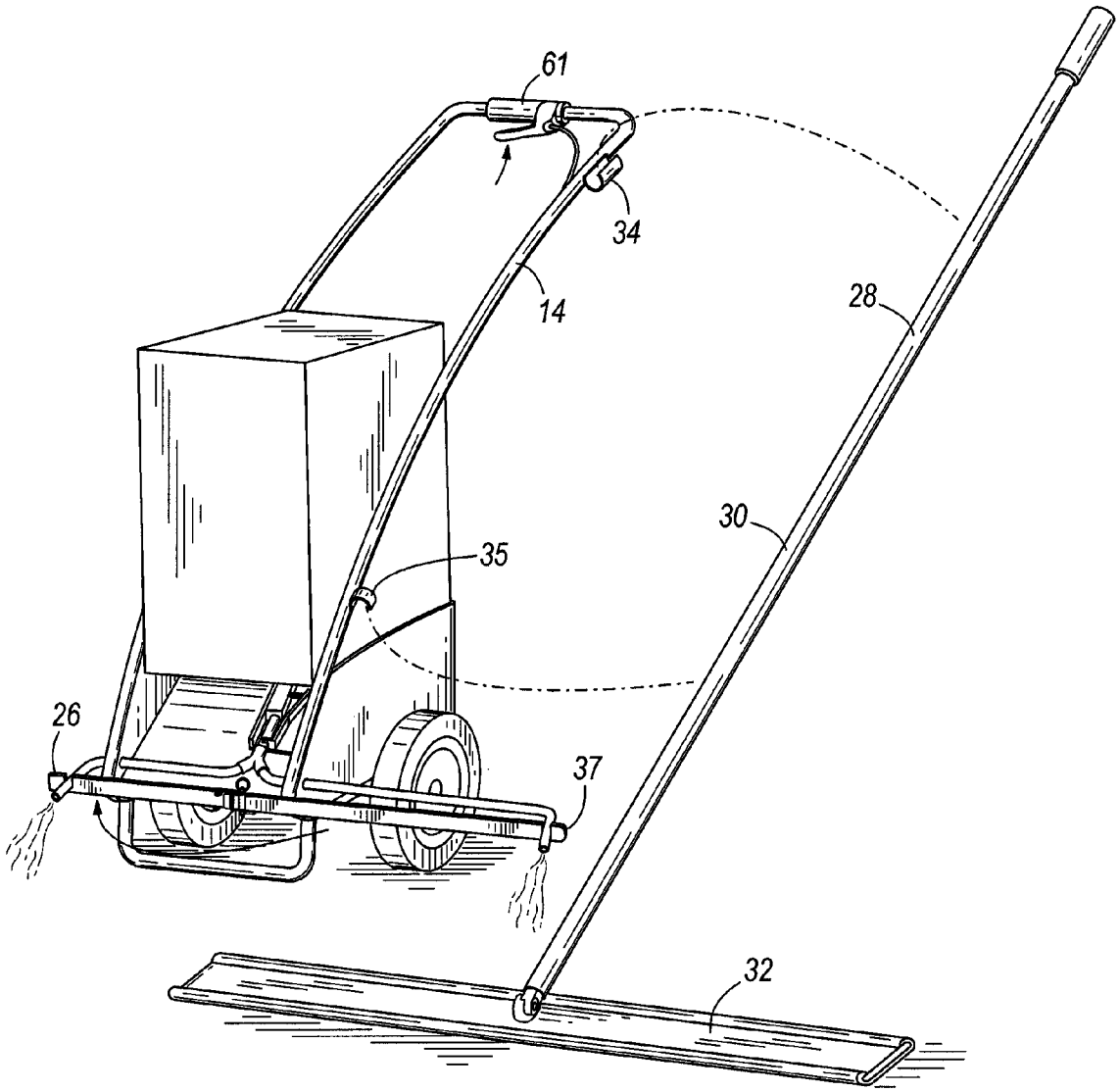
FIG. 3 is a view similar to FIG. 2 showing the mop disconnected from the applicator.

Referring to FIGS. 1-3, the floor finish applicator generally 10 includes a cart 12 with a U-shaped tubular handle member 14 joined to a base portion 16 with wheels 18 rotatably mounted thereon. A box 21 with a bag 23 containing floor finish is supported on base portion 16 which provides a carrier member for the box 21. A sloping panel 24 encloses the base portion 16. Cart 12 is supported by skid member 22. Also connected to the handle member 14 is a spreader bar member 26 with a second spreader bar member 37 connected thereto. Spreader bar members 26 and 37 support floor finish conveying, flexible conduits 25 and 29 for depositing floor finish on floor surface 27. A mop generally 28 having a handle 30 and pad 32 is removably attached to the handle member 14 by the clamps 34 and 35. In a preferred manner, mop pad 32 is comprised of materials of different sizes for purpose of spreading and leveling the floor finish. It can be made of foam, flocked foam, woven or non-woven cloth.

Figure 5:
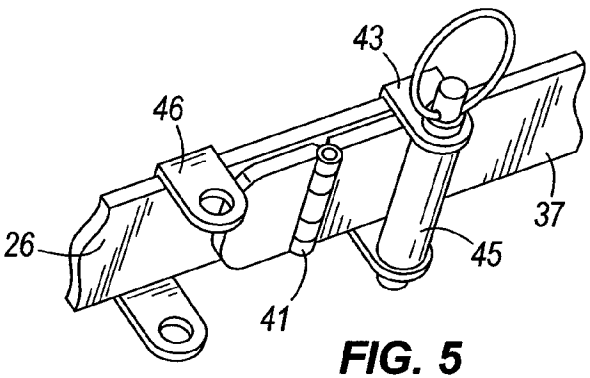
FIG. 5 is a detailed view showing the connection of the pivotal connecting spreader bar member.
Figure 6:
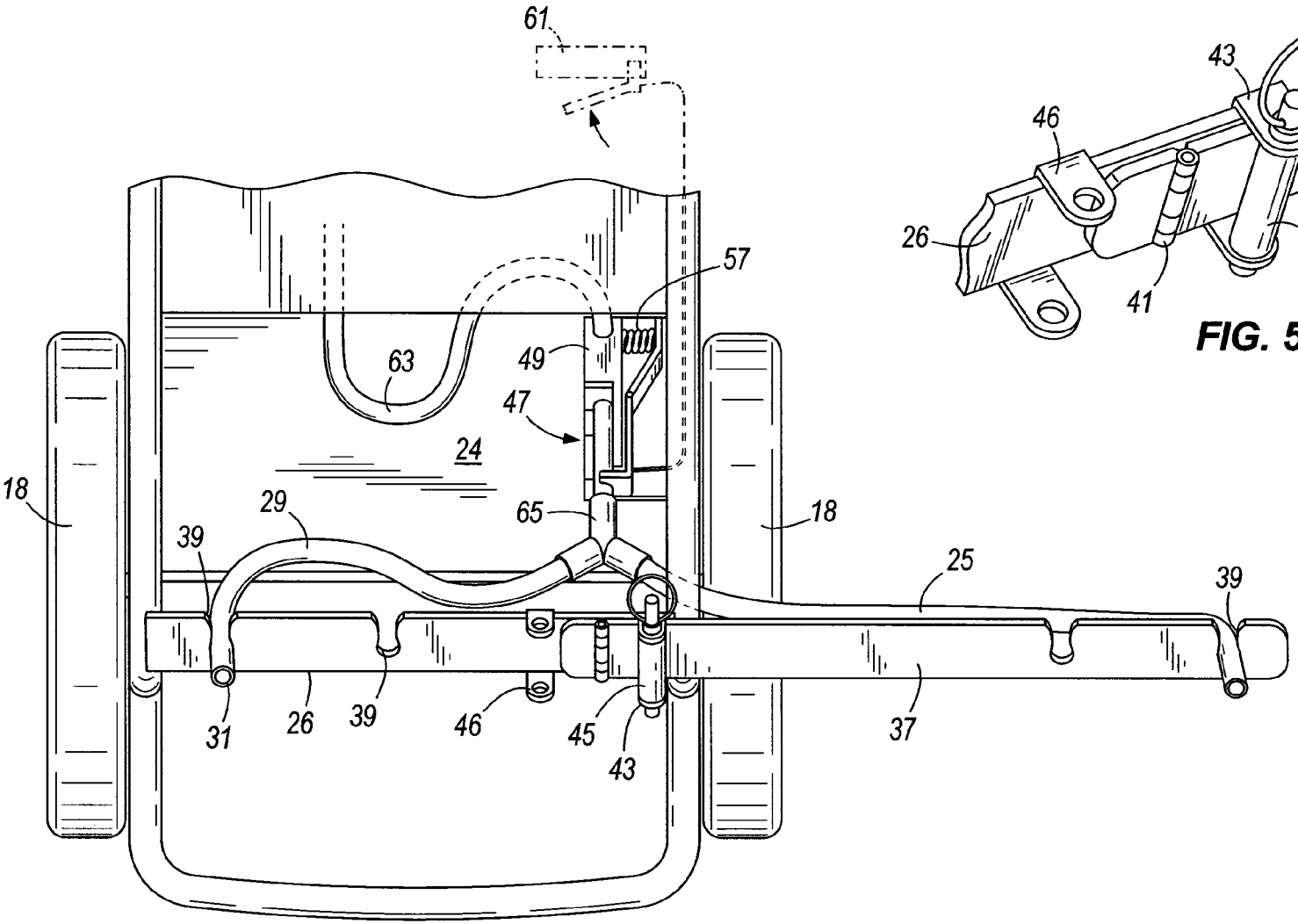
FIG. 6 is a front partial view showing the spreader bar member supporting the floor finish conveying conduits.
Figure 7:
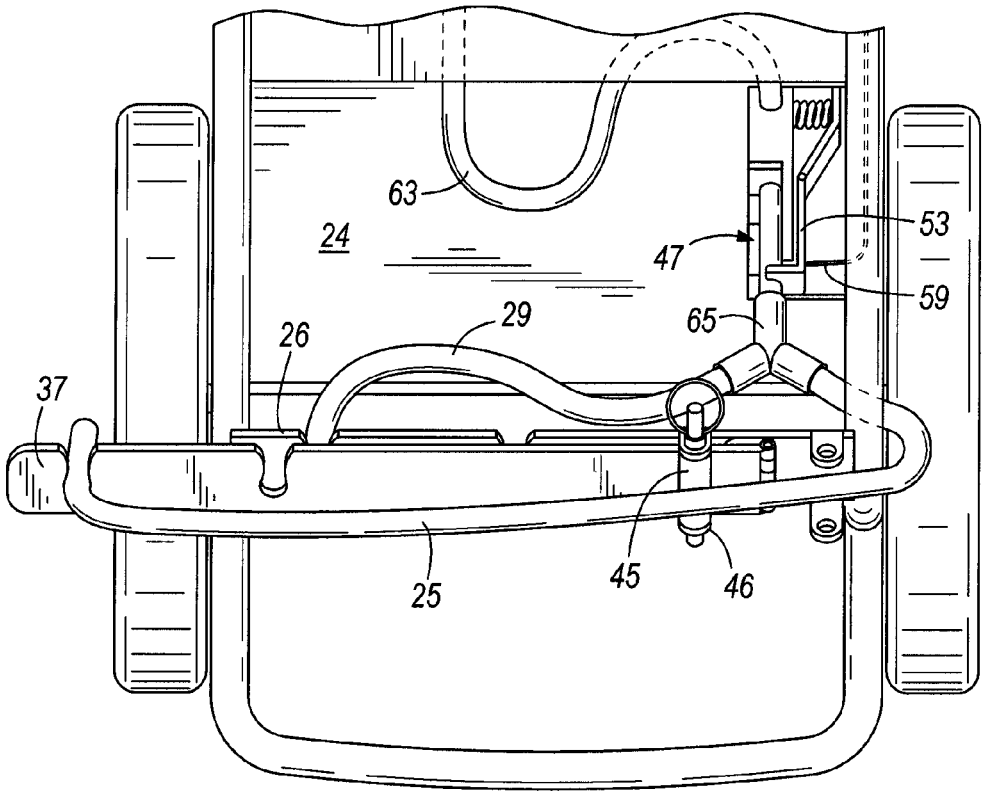
FIG. 7 is a view similar to FIG. 6 illustrating the spreader bar members in a folded condition.

Referring to FIGS. 5-7, spreader barmember 37 is pivotally connected to spreader bar member 26 by means of hinge 41. It is held in a hinged open position by bracket 43 and the pin 45. A second bracket 46 is connected to spreader bar member 26. This serves to clamp pivotal spreader bar 37 in a folded position as seen in FIG. 7 when pin 45 is placed in bracket 46. Spreader bar members 26 and 37 have notches 39 for supporting conduits 25 and 29 therein.

Figure 8:
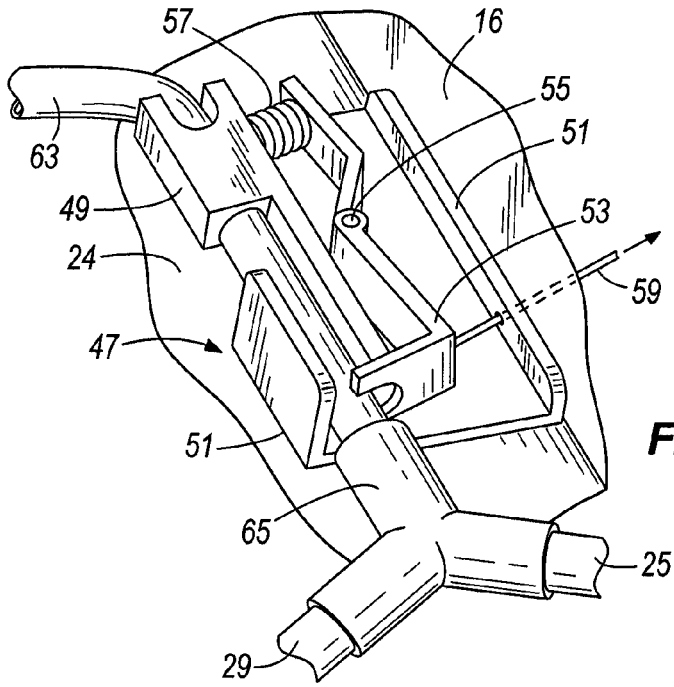
FIG. 8 is a detailed view of the valve for controlling the flow of floor finish through the floor finish conveying conduits.

The flow of floor finish from bag 23 to conduits 25 and 29 is controlled by the control pinch clamp generally 47 connected to sloping panel 24. This is best seen in FIG. 8. Feed tube 63 is connected to bag 23 and extends through pinch clamp 47 which includes body member 49 and clamp plate 51. Clamp member 53 is biased closed by spring 57 to position clamp member 53 in engagement with feed tube 63. This is seen in FIG. 7. Clamp member 53 is opened by the cable 59 connected to hinged clamp member 53 having support hinge 55. A control lever 61 on handle member 14 pulls cable 59 to open clamp member 53. Feed tube 63 is interconnected to conduits 25 and 29 by the Y connector 65.

OPERATION

Figure 4:
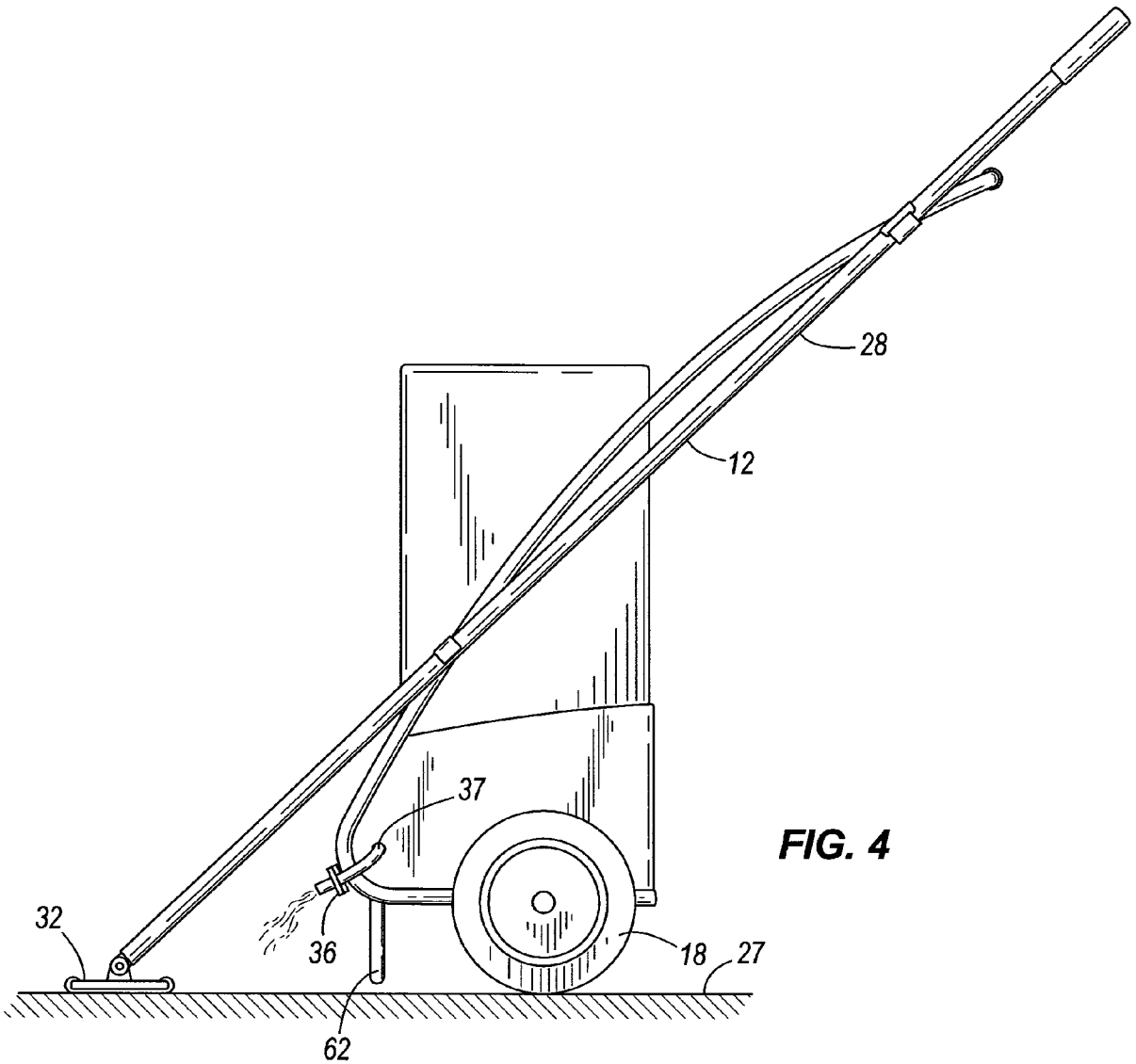
FIG. 4 is a side view of the applicator with the mop attached and illustrating the dispensing of floor finish.

A further understanding of the floor finish applicator 10 can be had by a description of its operation as seen in FIGS. 1-8. The bag 23 containing floor finish is placed in box 21 and the box loaded onto the cart 10 as illustrated in FIG. 1. Bag 23 is connected to feed tube 63 as indicated in FIG. 6 which shows control clamp 47 in the closed position and pinching off the feed tube 63. Initially, pivotal spreader bar member 37 is in a folded position as illustrated in FIG. 7. To extend bar 37, pin 45 is pulled from bracket 46 and spreader bar member 37 pivotally extended to the position shown in FIG. 6 by means of hinge 41. Pin 45 is then placed in bracket 43 to secure spreader bar 37 member to bar 26. This provides an offset position from a central axis of the cart 12 and places the open ends of 31 and 32 of conduits 29 and 25, respectively in a dispensing position. The open ends 31 and 33 have dispensing nozzles such as nozzle 36 attached thereto as seen in FIG. 4. Mop handle 30 is clamped to handle member 14 by means of clamps 34 and 35. It is positioned to extend in front of cart 12 and extended in a manner to lift skid member 22 so as to place a portion of the weight of the loaded cart 12 on the mop pad 32. This is seen in FIG. 4. This arrangement positions the cart about 5 degrees from an upright position.

Pinch valve 47 is opened by compressing lever 61 which places the pinch clamp 47 in the position seen in FIG. 8. Floor finish then flows through conduits 25 and 29 and out through nozzles such as 36. Floor finish is distributed by the mop pad 32 as the cart 12 is moved in a backward manner. In order to apply floor finish to a surface not easily accessible by the cart 12, the mop 28 is unclamped therefrom and employed in the usual manner.

It will thus be seen that there is provided a floor finish applicator composed of consumable parts. This is seen though the use of the bag 23 in the box 21 as well as plastic feed tube 63 and conduits 25and 29. These parts are readily disposable after use. Further, floor finish applicator 10 provides a dual use of mop 28. It acts as a spreader for the floor finish when attached to the cart 12, yet allows use separately as a hand operated mop.

A particular pinch valve 47 has been described in conjunction with applicator 10. Any type of clamp could be employed which effects a compressing and stoppage of flow through flexible tubing 63. Neither is the particular design of mop 28 essential. Any mop with a disposable mop head can be substituted as long as it effects appropriate spreading and leveling of the floor finish. All such and other modifications within the spirit of the invention are meant to be within the scope as defined by the appended claims.

What is claimed is:

1. A walk-behind floor finish applicator comprising:

a wheeled cart constructed and arranged to receive a source of floor finish;

a floor finish spreading mop having a floor finish spreading member and a handle member extending away from the floor finish spreading member, the floor finish spreading mop detachably mounted on the cart via first and second releasable clamps disposed a distance from one another to position, the floor finish spreading member on a front side of the cart;

a spreader bar member mounted on a front side of the cart;

at least one conduit connected to the source of floor finish and the spreader bar member for depositing floor finish on a floor;

a valve member operatively associated with the conduit; and a valve actuating member operatively connected to the valve member.

2. The applicator of claim 1 further including a skid member connected to the cart, the floor finish spreading member positioned in a manner to place the cart at about 5 degrees from an upright position toward the front side of the cart.

3. The applicator of claim 1 further including a carrier member connected to the cart and a bag in the box containing a floor finish positioned in the carrier member.

4. The applicator of claim 3 wherein the cart is formed from a U-shaped tubular handle member joined to the carrier member.

5. The applicator of claim 1 further including two spreader bar members with one spreader bar member pivotally connected to the other spreader bar member and fastened thereto by bracket member and a pin.

6. The applicator of claim 1 wherein the spreader member supports two of the conduit members.

7. The applicator of claim 1 wherein the valve member is a pinch valve.

8. The applicator of claim 1 wherein the mop includes materials of different sizes.

9. The applicator of claim 1 wherein the spreader bar is offset from a central axis of the cart.

10. A walk-behind floor finish applicator comprising:

a wheeled cart constructed and arranged to receive a source of floor finish, the wheeled cart having a front side, a rear side opposite the front side, two lateral sides extending between and connecting the front and rear sides, and at least one wheel rotatable about an axis transverse to the lateral sides of the cart;

a floor finish spreading mop having a handle member and a floor finish spreading member detachably mounted to the cart at a location on one of the lateral sides of the cart and in a position in which the handle member of the floor finish spreading mop extends along and is located on one of the two lateral sides of the cart, and in which the floor finish spreading member is in a ground-engaging position on a front side of the cart;

a spreader bar member mounted on a front side of the cart;

at least one conduit connected to the source of floor finish and the spreader bar member for depositing floor finish on a floor;

a valve member operatively associated with the conduit; and a valve actuating member operatively connected to the valve member.

11. The applicator of claim 10 further including a skid member connected to the cart, the floor finish spreading member positioned in a manner to place the cart in a forwardly-tilted direction.

12. The applicator of claim 10 further including a carrier member connected to the cart and a removable container containing a floor finish positioned in the carrier member.

13. The applicator of claim 12 wherein the cart is formed from a U-shaped tubular handle member joined to the carrier member.

14. The applicator of claim 10 further including two spreader bar members with one spreader bar member pivotally connected to the other spreader bar member.

* * * * *